US006878237B2

(12) United States Patent
Scheideler

(10) Patent No.: US 6,878,237 B2
(45) Date of Patent: Apr. 12, 2005

(54) MACHINE AND PROCESS FOR OPERATING A MACHINE TO MONITOR VIBRATIONS

(75) Inventor: Eva Scheideler, Nattheim (DE)

(73) Assignee: Voith Paper Patent GmbH, Heidenheim (DE)

( * ) Notice: Subject to any disclaimer, the term of this patent is extended or adjusted under 35 U.S.C. 154(b) by 42 days.

(21) Appl. No.: 10/396,345

(22) Filed: Mar. 26, 2003

(65) Prior Publication Data

US 2003/0188583 A1 Oct. 9, 2003

(30) Foreign Application Priority Data

Mar. 27, 2002 (DE) ..... 102 13 851

(51) Int. Cl.[7] ..... D21F 3/04; D21F 7/06; G21G 7/00

(52) U.S. Cl. ..... 162/198; 162/199; 162/263; 162/272; 162/258.1; 162/361; 100/160; 73/645

(58) Field of Search ..... 162/198, 199, 162/204, 205, 252, 253, 262, 263, 272, 283, DIG. 10; 700/127–129; 73/645–648, 862.55; 242/534; 100/48–50, 37, 155 R, 160, 176

(56) References Cited

U.S. PATENT DOCUMENTS

| | | | | |
|---|---|---|---|---|
| 4,505,154 A | * | 3/1985 | Wiesner | 73/150 R |
| 5,083,976 A | * | 1/1992 | McClure et al. | 460/1 |
| 5,768,985 A | | 6/1998 | Lehtovirta et al. | |
| 5,915,297 A | | 6/1999 | Lehtovirta et al. | |
| 5,971,315 A | * | 10/1999 | Kojo | 242/534.2 |
| 6,270,628 B1 | | 8/2001 | Suomi et al. | |
| 6,387,214 B1 | * | 5/2002 | Kustermann et al. | 162/198 |
| 6,463,775 B1 | * | 10/2002 | Kodama et al. | 72/13.4 |
| 6,500,304 B1 | | 12/2002 | Holopainen et al. | |
| 6,750,621 B2 | * | 6/2004 | Gandrud | 318/114 |
| 2002/0060021 A1 | | 5/2002 | Kayser et al. | |
| 2004/0079147 A1 | * | 4/2004 | Maenpaa | 73/159 |

FOREIGN PATENT DOCUMENTS

| | | | |
|---|---|---|---|
| DE | 10019506 | 1/2001 | |
| DE | 10008800 | 9/2001 | |
| EP | 0779394 | 6/1997 | |
| EP | 779394 | 6/1997 | |
| WO | 9920836 | 4/1999 | |
| WO | 99/20836 | 4/1999 | |
| WO | 0009805 | 2/2000 | |
| WO | WO 00/72989 | * 12/2000 | B21B/38/00 |
| WO | 0150030 | 7/2001 | |

OTHER PUBLICATIONS

Japanese Patent Abstract No. 04041793 A, published Feb. 12, 1992.

Chen et al., "Calender Barring on Paper Machines–Practical Conclusions and Recommendations" *TechnicalAssociationof the Pulp & Paper Industry* (*TAPPI*), Aug. 8, 1975, pp. 147–151, vol. 58, No. 8, XP002216957.

* cited by examiner

*Primary Examiner*—Peter Chin
*Assistant Examiner*—Eric Hug
(74) *Attorney, Agent, or Firm*—Greenblum & Bernstein, P.L.C.

(57) ABSTRACT

Machine and process for operating machine having at least one roll and an opposing surface arranged to form at least one nip. The machine includes at least one roll and an opposing surface arranged to form at least one nip. A sound measuring device is arranged to conduct sound measurements in at least one of an area of the at least one roll and an area of the at least one nip to monitor vibrations in the at least one roll and/or in the at least one nip. The instant abstract is neither intended to define the invention disclosed in this specification nor intended to limit the scope of the invention in any way.

68 Claims, 2 Drawing Sheets

MACHINE AND PROCESS FOR OPERATING A MACHINE TO MONITOR VIBRATIONS

CROSS-REFERENCE TO RELATED APPLICATIONS

The present application claims priority under 35 U.S.C. §119 of German Patent Application No. 102 13 851.6, filed on Mar. 27, 2002, the disclosure of which is expressly incorporated by reference herein in its entirety.

BACKGROUND OF THE INVENTION

1. Field of the Invention

The present invention relates to a process for operating a machine, e.g., a paper machine, a stand alone (off-line) calender, speed sizer, size press, etc., in which vibrations that occur on at least one roll and/or in at least one nip formed between a roll and an opposing surface, in particular an opposing roll, are monitored. It further relates to a corresponding machine, e.g., a paper machine, a stand alone (off-line) calender, speed sizer, size press, etc.

2. Discussion of Background Information

Processes and paper machines of the type mentioned at the outset are described in International Publication No. WO 99/20836 and in European Patent Application No. EP 0 779 394 A1.

Transverse stripes can occur on the paper web, in particular in connection with the use of roll coatings, e.g., in machine calenders, calenders, coating units, in particular size presses and/or the like. As soon as these stripes become visible, the paper web is unusable and forms broke. This so-called "barring effect" is probably the effects of vibration phenomena.

SUMMARY OF THE INVENTION

The present invention provides an improved process and an improved machine of the type mentioned at the outset, with which an early recognition of the barring effect, of wavinesses in the roll covering and/or similar phenomena is possible, in order if necessary to be able to start appropriate countermeasures in time.

The present invention includes a process for operating a machine, e.g., a paper machine, a stand alone (off-line) calender, speed sizer, size press, etc., in which vibrations that occur on at least one roll and/or in at least one nip formed between a roll and an opposing surface, in particular an opposing roll, are monitored by a sound measurement conducted in the area of the roll or in the area of the nip.

Due to this embodiment, the barring effect can be recognized at a very early stage, so that it is now possible to start countermeasures in time. As a result above all longer roll service lives are thus obtained.

According to a preferred practical embodiment of the process according to the invention, an airborne sound measurement is conducted.

The sound measurement is made advantageously in the direct proximity of the roll or the nip.

The sound measurement can be conducted and/or analyzed repeatedly, whereby preferably a periodic sound measurement or analysis is provided. However, in principle a continuous sound measurement and/or analysis is also possible.

For instance, a respective sound level measurement or sound intensity measurement can be made.

The sound measurement is advantageously conducted by at least one sound sensor, in particular a sound pressure sensor, in particular a microphone.

A preferred practical embodiment of the process according to the invention is remarkable because an obtained sound measurement value or a value derived from it is compared with a preset upper limit value and, if this limit value is exceeded, the exceeding of the limit value is signaled and/or control and/or regulating steps are activated which counteract the vibrations or reduce the vibrations to a minimum.

The sound measurement is advantageously conducted in the area of at least one roll with a tendency towards a barring effect or in the area of at least one nip with a tendency towards such a barring effect. The sound measurement can thereby be conducted in particular in the area of at least one roll provided with a covering and/or in the area of at least one elastic roll.

The sound measurement can be conducted, e.g., in the area of a calender, a machine calender, a size press, a guide roll and/or the like.

A respective sound measurement can be conducted, e.g., in the area of the jacket of the respective roll, in the area of a roll bearing and/or in the area of a roll face.

The vibrations detected in the manner described can be counteracted by various actuators or measures.

According to a preferred practical embodiment of the process according to the invention, the vibrations are counteracted via a corresponding roll displacement in the axial direction and/or in the machine running direction. Such a measure is particularly advantageous with a calender. A roll displacement preferably occurs in the machine running direction.

According to another advantageous embodiment the vibrations are counteracted via a corresponding control and/or regulation of the rigidity and/or the damping of an active roll bearing. An active roll bearing can thereby be used, e.g., as described in German Patent Application No. DE 100 19 506 A1.

In certain cases it is also advantageous to counteract the vibrations via a corresponding control and/or regulation of the roll- and/or roll coating temperature. A corresponding control and/or regulation of the cooling water temperature or the cooling water effect, for example, can thereby be provided.

With a sag compensation roll, the vibrations can be counteracted, e.g., via a corresponding control and/or regulation of the damping of the hydraulic system of the inner support sources of the sag compensation roll.

With a size press, the vibrations can be counteracted, e.g., via a corresponding control and/or regulation of the paint- or glue temperature and/or the viscosity of the respective paint- or glue material.

The sound measurement values obtained are preferably subjected to a frequency analysis. A so-called fast Fourier transform is suitable in particular thereby.

In a practical embodiment the entire spectrum is measured or considered in the sound measurement and/or in the sound analysis.

In another preferred practical embodiment of the process according to the invention, only at least one preset frequency band is measured or considered in the sound measurement and/or sound analysis.

According to another preferred practical embodiment of the process according to the invention, the sound measurement is conducted for at least one preset frequency and/or at least one sound measurement value obtained for a preset frequency is compared with a preset upper limit value. For example, at least one barring frequency that can be determined in advance can thereby be considered.

The invention is also directed to a machine with a device for monitoring vibrations that occur on at least one roll and/or in at least one nip formed between a roll and an opposing surface, in particular an opposing roll, whereby the monitoring device comprises a sound measurement device through which a sound measurement can be conducted in the area of the roll or in the area of the nip.

The present invention is directed to a machine. The machine includes at least one roll and an opposing surface. The at least one roll and the opposing surface are arranged to form at least one nip. A sound measuring device is arranged to conduct sound measurements in at least one of an area of the at least one roll and an area of the at least one nip to monitor vibrations in the at least one roll and/or in the at least one nip.

According to a feature of the invention, the opposing surface can include an opposing roll.

In accordance with another feature of the invention, the sound measuring device may include an airborne sound measurement.

The sound measuring device can be structured and arranged for measuring sound in direct proximity of the at least one roll or the at least one nip.

Further, the sound measuring device may be is structured to at least one of repeatedly conduct and repeatedly analyze sound measurement. The sound measuring device can be structured to at least one of periodically conduct and periodically analyze sound measurements.

According to the invention, the sound measuring device can be structured to at least one of continuously conduct and continuously analyze sound measurements.

In accordance with another feature of the present invention, the sound measuring device can include a sound level measurement device.

According to still another feature, the sound measuring device may include a sound intensity measurement device.

The sound measuring device can include at least one sound sensor. Further, the at least one sound sensor may include comprises a sound pressure sensor, and the sound pressure sensor can include a microphone.

The sound measuring device can include comprises a control and/or regulating device structured and arranged to compare a measured sound value with a preset upper limit value. The control and/or regulating device may include actuators such that, if the upper limit value is exceeded by the measured sound value, the actuators are arranged to actuate at least one of a signal device and/or a device for counteracting the vibrations or for reducing the vibrations to a minimum.

In accordance with a further feature of the invention, the at least one roll can exhibit a tendency towards a barring effect or the at least one nip can exhibit a tendency towards a barring effect.

According to a still further feature of the instant invention, the at least one roll can include a covering, and the at least one roll may include an elastic roll.

Moreover, the at least one roll can be arranged within a calender, a machine calender, a size press, and a guide roll.

Still further, the at sound measuring device can be positioned in an area of a roll jacket of the at least one roll.

In accordance with another feature of the instant invention, the sound measuring device can be positioned in an area of a roll bearing of the at least one roll.

According to still another feature, the sound measuring device may be positioned in an area of a roll face of the at least one roll.

The sound measuring device can include a vibration counteracting device structured and arranged to displace the at least one roll in at least one of an axial direction and a machine running direction.

Further, the sound measuring device may include a vibration counteracting device structured and arranged to control and/or regulate at least one of a rigidity and damping of an active roll bearing of the at least one roll.

Still further, the sound measuring device can include a vibration counteracting device structured and arranged to control and/or regulate at least one of roll temperature and roll coating temperature of the at least one roll.

Moreover, the sound measuring device can include a vibration counteracting device structured and arranged to control and/or regulate a cooling water temperature of the at least one roll.

According to a further feature of the invention, the at least one roll can include a sag compensation roll having a hydraulic system of inner support sources and the sound measuring device may include a vibration counteracting device structured and arranged to control and/or regulate a damping of the hydraulic system of the sag compensation roll.

In accordance with a still further feature of the instant invention, the at least one roll can be arranged in a size press, and the sound measuring device may include a vibration counteracting device structured and arranged to control and/or regulate a paint or glue temperature and/or a viscosity of a paint or glue material.

Further, the sound measuring device can include an analyzing unit structured and arranged to subject sound values obtained by the sound measuring device to a frequency analysis. The analyzing unit can analyze an entire spectrum of the sound values.

According to another feature of the invention, the analyzing unit can analyze preset frequency bands of the sound values.

In accordance with still another feature of the present invention, the sound measuring device can be structured to measure at least one preset frequency of sound, and the machine may further include a comparing unit structured to compare a value of the measured at least one preset frequency of sound with a preset upper limit value.

According to the invention, the machine can be a paper machine, or a stand alone calender, or a speed sizer or size press.

The present invention is directed to a process for operating a machine having at least one roll and an opposing surface arranged to form at least one nip. The process includes rotating the at least one roll, whereby vibrations occur on the at least one roll and/or in at least one nip, and measuring sound conducted in an area of the at least one roll or in an area of the at least one nip.

In accordance with a feature of the invention, the opposing surface can include an opposing roll.

According to another feature of the instant invention, the sound measuring can include an airborne sound measurement.

In further accordance with the invention, the sound measuring can be performed in direct proximity of the at least roll or the least nip.

The process can further include repeatedly conducting and/or repeatedly analyzing the sound measuring. The sound measuring can be conducted periodically and/or analyzed periodically.

Moreover, the process can also include continuously conducting and/or analyzing the sound measuring.

According to still another feature of the present invention, the sound measuring can include a sound level measurement.

In accordance with a further feature, the sound measuring can include a sound intensity measurement.

The sound measuring can be performed by at least one sound sensor. The at least one sound sensor can include a sound pressure sensor, and the sound pressure sensor may include a microphone.

The process can also include comparing a value of the measured sound with a preset upper limit value and, if the value exceeds the upper limit value, at least one of signaling the exceeding the limit value and controlling and/or regulating actions to counteract the vibrations or reduce the vibrations to a minimum.

Still further, the at least one roll exhibits a tendency toward a barring effect and the at least one nip exhibits a tendency towards such a barring effect.

According to another feature of the present invention, the at least one roll may have at least one of a covering and is an elastic roll.

Further still, the at least one roll can be located in at least one of a calender, a machine calender, a size press, and a guide roll.

In accordance with the invention, the sound measuring may be performed in an area of a roll jacket of the at least one roll.

According to another feature, the sound measuring can be performed in an area of a roll bearing of the at least one roll.

According to still another feature of invention, the sound measuring can be performed in an area of a roll face of the at least one roll.

The process can further include counteracting the vibrations by displacing the at least one roll in at least one of an axial direction and a machine running direction.

According to another feature of the invention, the process may further include counteracting the vibrations by at least one of controlling and regulating at least one of a rigidity and or damping of an active roll bearing of the at least one roll.

In accordance with a further feature of the present invention, the process can also include counteracting the vibrations by at least one of controlling and regulating at least one of roll temperature and roll coating temperature.

Moreover, the process may include counteracting the vibrations by at least one of controlling and regulating a cooling water temperature.

Still further, the at least one roll can include a sag compensation roll having a hydraulic system for inner support sources, and the process can include counteracting the vibrations by at least one of controlling and regulating a damping of the hydraulic system of the inner support sources.

The at least one roll can be located in a size press, and the process may further include counteracting the vibrations by at least one of controlling and regulating at least one of a paint or glue temperature and a viscosity of the paint or glue material.

The process may also include analyzing sound values obtained through the sound measuring with a frequency analysis. An entire spectrum of the measured sound can be analyzed. At least one preset frequency band of the measured sound may be analyzed. Further, only one preset frequency band of the measured sound can be analyzed.

In accordance with still yet another feature of the present invention, the sound measuring can be performed for at least one preset frequency, and at least one sound value obtained through the sound measuring for a preset frequency may be compared with a preset upper limit value.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
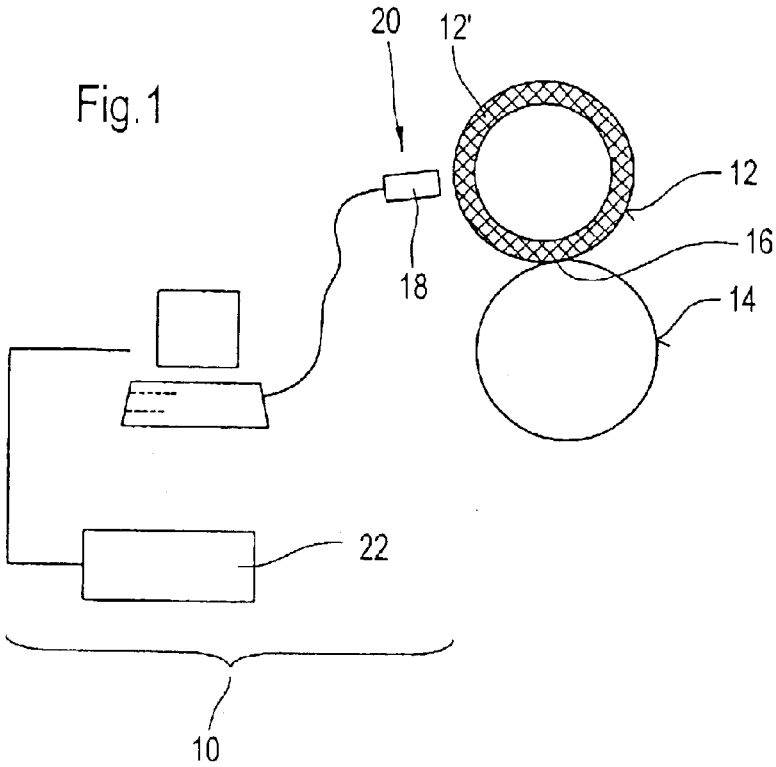
FIG. 1 diagrammatically illustrates a device for monitoring vibrations that can occur on a roll used, e.g., in a paper machine, stand alone (off-line) calender, speed sizer, or size press, etc., in which a sound measurement occurs in the area of the roll jacket.

FIG. 1 shows in diagrammatic representation a device 10 for monitoring vibrations that can occur on at least one roll and/or at least one nip formed between a roll and an opposing surface, in particular an opposing roll. FIG. 1 shows, for example, a roll arrangement comprising two rolls 12 and 14 forming a nip 16, which roll arrangement can be provided in a machine, e.g., a paper machine, a stand alone (off-line) calender, speed sizer, size press, etc.

Monitoring device 10 comprises at least one sound sensor 20 which can be in particular a sound pressure sensor, e.g., a microphone.

Roll 12 is, e.g., a roll with a tendency towards a barring effect. In the present case sound sensor 18 is arranged in the direct proximity of jacket 12' of roll 12.

Sound sensor 18 is part of a sound measurement device 20, e.g., integrated into monitoring device 10. In the present case, sound measurement device 20 or sound sensor 18 is embodied for an airborne sound measurement.

Monitoring or sound measurement device 10 and/or 20 can be embodied in particular such that the sound measurement and/or analysis can be conducted repeatedly. A periodic sound measurement or sound analysis is thereby preferably provided. However, in principle the sound measurement or sound analysis can also occur continuously.

For example the sound level and/or the sound intensity can be measured by sound sensor 18.

Monitoring device 10 can comprise in particular a control and/or regulating device 22. Thus, in particular at least one automatic control loop or control circuit for active and/or passive measures can be provided in monitoring system 10.

Monitoring system 10 including control and/or regulating device 22 can be designed in particular such that a respective obtained sound measurement value or a value derived from it is compared with a preset upper limit value and in the event of this limit value being exceeded the exceeding of the limit value is signaled and/or control and/or regulating steps activated which counteract the vibrations or reduce the vibrations to a minimum.

Roll 12 can be provided, e.g., with a coating and/or formed by an elastic roll.

The sound measurement can be conducted, e.g., in the area of a calender, a machine calender, a size press and/or the like. It can also be conducted, e.g., on a guide roll.

Figure 2:
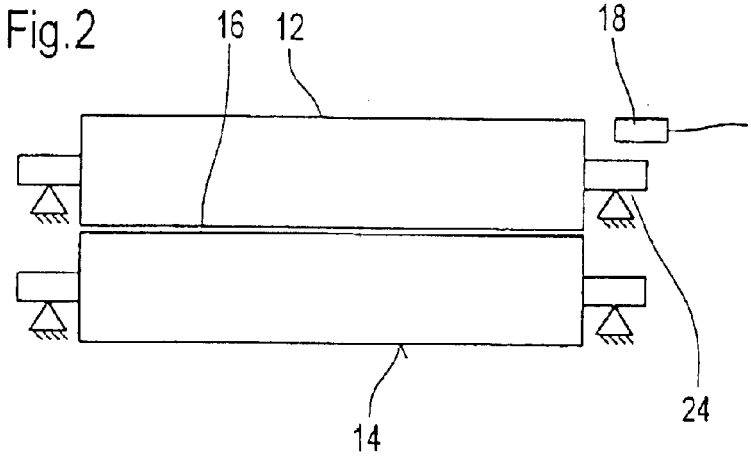
FIG. 2 diagrammatically illustrates a roll arrangement with assigned sound sensor that is arranged in the area of a roll bearing.

FIG. 2 shows in diagrammatic representation again a roll arrangement with two rolls 12 and 14, between which a nip 16 is formed. In the present case, however, sound sensor 18 is arranged in the area of a roll bearing 24. Sound sensor 18 can thereby be provided, e.g., in the direct proximity of roll bearing 24 of upper roll 12.

Sound sensor 18 can be in particular again a sound pressure sensor, e.g., a microphone.

Otherwise the monitoring device can be embodied again in particular as is described in connection with FIG. 1.

Figure 3:
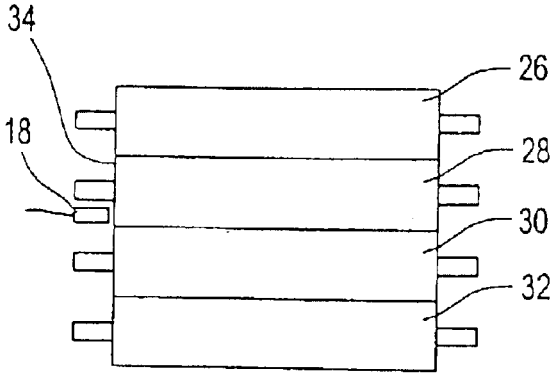
FIG. 3 diagrammatically illustrates a roll arrangement with assigned sound sensor that is arranged in the area of a roll face.

FIG. 3 shows in diagrammatic representation a roll arrangement comprising, e.g., four rolls 26, 28, 30, and 32. In the present case a sound sensor 18 is arranged in the direct proximity of a face 34, e.g., the second roll from the top, i.e., roll 28.

Also, in the present case, sound sensor 18 can be, e.g., a sound pressure sensor, e.g., a microphone. As with the other exemplary embodiments, in principle, e.g., a sound level measurement or a sound intensity measurement is conceivable.

Otherwise, monitoring device 10 can be embodied in particular again as described in connection with FIG. 1.

Figure 4:
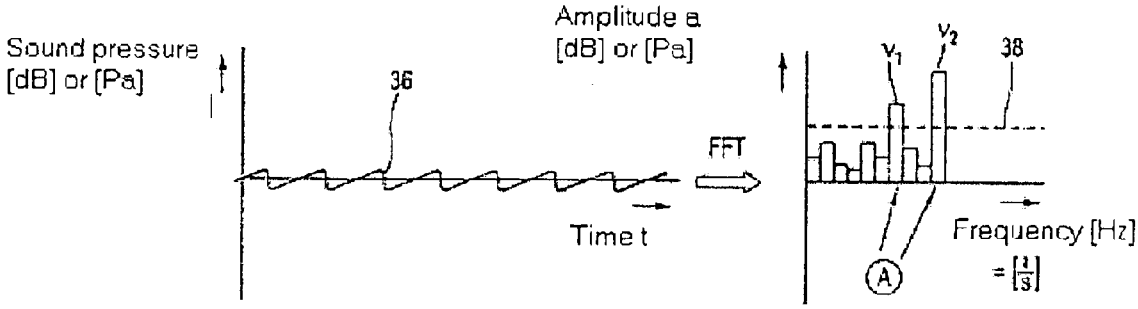
FIG. 4 diagrammatically illustrates the conversion of a sound measurement signal from the time area into the frequency area by a fast Fourier transform.

FIG. 4 shows in diagrammatic representation the conversion of a sound measurement signal 36 from the time area (left-hand portion of FIG. 4) to the frequency area (right-hand portion of FIG. 4) by means of a fast Fourier transform (FFT).

The left part of FIG. 4 shows the time course of the obtained sound measurement signal, e.g., the sound pressure shown over the time. The values can be given, e.g., in "dB" or in "Pa" or voltage.

By the fast Fourier transform (FFT), sound measurement signal 36 is transferred into the frequency area (see the right-hand portion of FIG. 4). In the respective diagram in the right part of FIG. 4 the amplitude is plotted over the frequency. The amplitudes can be given, e.g., in "dB" or in "Pa" or voltage.

The amplitudes obtained in the frequency area for the various frequencies $v_i$ are each compared with a preset upper limit value 38 in order to be able if necessary to start active and/or passive measures if this limit value is exceeded. In the present case, limit value 38 is exceeded by the amplitudes at frequencies $v_1$ and $v_2$. If these are critical frequencies, e.g., with regard to the mentioned barring effect, the relevant measures are to be taken. Exceeding limit value 38 can be, e.g., an indication that the rolls are becoming non-circular. The relevant vibrations can then be counteracted, e.g., by a corresponding roll displacement.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

List of Reference Numbers

10 Monitoring device
12 Roll
14 Roll
16 Nip
18 Sound sensor
20 Sound measurement device
22 Control and/or regulating device
24 Roll bearing
26 Roll
28 Roll
30 Roll
32 Roll
34 Face
36 Sound measurement signal
38 Limit value

What is claimed:

1. A machine comprising:

at least one roll comprising an elastic roll;

an opposing surface, said at least one roll and said opposing surface are arranged to form at least one nip; and a sound measuring device arranged to conduct sound measurements in at least one of an area of said at least one roll and an area of said at least one nip to monitor vibrations in at least one of said at least one roll and said at least one nip.

2. The machine in accordance with claim 1, wherein said opposing surface comprises an opposing roll.

3. The machine in accordance with claim 1, wherein said sound measuring device comprises an airborne sound measurement.

4. The machine in accordance with claim 1, wherein said sound measuring device is structured and arranged for measuring sound in direct proximity of one of said at least one roll and said at least one nip.

5. The machine in accordance with claim 1, wherein said sound measuring device is structured to at least one of repeatedly conduct and repeatedly analyze sound measurement.

6. The machine in accordance with claim 5, wherein said sound measuring device is structured to at least one of periodically conduct and periodically analyze sound measurements.

7. The machine in accordance with claim 1, wherein said sound measuring device is structured to at least one of continuously conduct and continuously analyze sound measurements.

8. The machine in accordance with claim 1, wherein said sound measuring device comprises a sound level measurement device.

9. The machine in accordance with claim 1, wherein said sound measuring device comprises a sound intensity measurement device.

10. The machine in accordance with claim 1, wherein said sound measuring device comprises at least one sound sensor.

11. The machine in accordance with claim 10, wherein said at least one sound sensor comprises a sound pressure sensor.

12. The machine in accordance with claim 11, wherein said sound pressure sensor comprises a microphone.

13. The machine in accordance with claim 1, wherein said sound measuring device comprises at least one of a control and a regulating device structured and arranged to compare a measured sound value with a preset upper limit value.

14. The machine in accordance with claim 13, wherein said at least one control and regulating device comprises actuators such that, if the upper limit value is exceeded by the measured sound value, said actuators are arranged to actuate at least one of a signal device, a device for counteracting the vibrations, and a device for reducing the vibrations to a minimum.

15. The machine in accordance with claim 1, wherein said at least one roll comprises a covering.

16. The machine in accordance with claim 1, wherein said at least one roll is arranged within at least one of a calender, a machine calender, a size press, and a guide roll.

17. The machine in accordance with claim 1, wherein said at sound measuring device is positioned in an area of a roll jacket of said at least one roll.

18. The machine in accordance with claim 1, wherein said sound measuring device is positioned in an area of a roll bearing of said at least one roll.

19. The machine in accordance with claim 1, wherein said sound measuring device is positioned in an area of a roll face of said at least one roll.

20. The machine in accordance with claim 1, wherein said sound measuring device comprises a vibration counteracting device structured and arranged to displace said at least one roll in at least one of an axial direction and a machine running direction.

21. The machine in accordance with claim 1, wherein said sound measuring device comprises a vibration counteracting device structured and arranged to at least one of control and regulate at least one of a rigidity and damping of an active roll bearing of said at least one roll.

22. The machine in accordance with claim 1, wherein said sound measuring device comprises a vibration counteracting device structured and arranged to at least one of control and regulate at least one of roll temperature and roll coating temperature of said at least one roll.

23. The machine in accordance with claim 1, wherein said sound measuring device comprises a vibration counteracting device structured and arranged to at least one of control and regulate a cooling water temperature of said at least one roll.

24. The machine in accordance with claim 1, wherein said at least one roll comprises a sag compensation roll having a hydraulic system of inner support sources and said sound measuring device comprises a vibration counteracting device structured and arranged to at least one of control and regulate a damping of the hydraulic system of said sag compensation roll.

25. The machine in accordance with claim 1, wherein said at least one roll is arranged in a size press, and said sound measuring device comprises a vibration counteracting device structured and arranged to control and/or regulate a paint or glue temperature and/or a viscosity of a paint or glue material.

26. The machine in accordance with claim 1, wherein said sound measuring device comprises an analyzing unit structured and arranged to subject sound values obtained by the sound measuring device to a frequency analysis.

27. The machine in accordance with claim 26, wherein said analyzing unit analyzes an entire spectrum of said sound values.

28. The machine in accordance with claim 1, wherein said analyzing unit analyzes preset frequency bands of said sound values.

29. The machine in accordance with claim 1, wherein said sound measuring device is structured to measure at least one preset frequency of sound, and said machine further comprises a comparing unit structured to compare a value of the measured at least one preset frequency of sound with a preset upper limit value.

30. The machine in accordance with claim 1, wherein the machine comprises a paper machine.

31. The machine in accordance with claim 1, wherein the machine comprises a stand alone calender.

32. The machine in accordance with claim 1, wherein the machine comprises a speed sizer.

33. The machine in accordance with claim 1, wherein the machine comprises a size press.

34. A machine comprising:

at least one roll;

an opposing surface, said at least one roll and said opposing surface are arranged to form at least one nip; and a sound measuring device arranged to conduct sound measurements in at least one of an area of said at least one roll and an area of said at least one nip to monitor vibrations in at least one of said at least one roll and said at least one nip, wherein said at least one roll exhibits a tendency towards a barring effect or said at least one nip exhibits a tendency towards a barring effect.

35. A process for operating a machine having at least one roll comprising an elastic roll and an opposing surface arranged to form at least one nip, said process comprising:

rotating the at least one roll, whereby vibrations occur on at least one of the at least one roll and in at least one nip; and measuring sound conducted in an area of at least one of the at least one roll and an area of the at least one nip.

36. The process in accordance with claim 35, wherein the opposing surface comprises an opposing roll.

37. The process in accordance with claim 35, wherein the sound measuring comprises an airborne sound measurement.

38. The process in accordance with claim 35, wherein the sound measuring is performed in direct proximity of the at least roll or the least nip.

39. The process in accordance with claim 35, further comprising at least one of repeatedly conducting and repeatedly analyzing the sound measuring.

40. The process in accordance with claim 39, wherein the sound measuring is at least one of conducted periodically and analyzed periodically.

41. The process in accordance with claim 35, further comprising continuously at least one of conducting and analyzing the sound measuring.

42. The process in accordance with claim 35, wherein the sound measuring comprises a sound level measurement.

43. The process in accordance with claim 35, wherein the sound measuring comprises a sound intensity measurement.

44. The process in accordance with claim 35, wherein the sound measuring is performed by at least one sound sensor.

45. The process in accordance with claim 44, wherein the at least one sound sensor comprises a sound pressure sensor.

46. The process in accordance with claim 45, wherein the sound pressure sensor comprises a microphone.

47. The process in accordance with claim 35, further comprising:

comparing a value of the measured sound with a preset upper limit value; and if the value exceeds the upper limit value, at least one of signaling the exceeding the limit value and controlling and/or regulating actions to counteract the vibrations or reduce the vibrations to a minimum.

48. The process in accordance with claim 35, wherein the at least one roll exhibits a tendency toward a barring effect and the at least one nip exhibits a tendency towards such a barring effect.

49. The process in accordance with claim 35, wherein the at least one roll has at least one of a covering.

50. The process in accordance with claim 35, wherein the at least one roll is located in at least one of a calender, a machine calender, a size press, and a guide roll.

51. The process in accordance with claim 35, wherein the sound measuring is performed in an area of a roll jacket of the at least one roll.

52. The process in accordance with claim 35, wherein the sound measuring is performed in an area of a roll bearing of the at least one roll.

53. The process in accordance with claim 35, wherein the sound measuring is performed in an area of a roll face of the at least one roll.

54. The process in accordance with claim 35, further comprising counteracting the vibrations by displacing the at least one roll in at least one of an axial direction and a machine running direction.

55. The process in accordance with claim 35, further comprising counteracting the vibrations by at least one of controlling and regulating at least one of a rigidity and or damping of an active roll bearing of the at least one roll.

56. The process in accordance with claim 35, further comprising counteracting the vibrations by at least one of controlling and regulating at least one of roll temperature and roll coating temperature.

57. The process in accordance with claim 35, further comprising counteracting the vibrations by at least one of controlling and regulating a cooling water temperature.

58. The process in accordance with claim 35, wherein the at least one roll comprises a sag compensation roll having a hydraulic system for inner support sources, and the process further comprises counteracting the vibrations by at least one of controlling and regulating a damping of the hydraulic system of the inner support sources.

59. The process in accordance with claim 35, wherein the at least one roll is located in a size press, and the process further comprises counteracting the vibrations by at least one of controlling and regulating at least one of a paint or glue temperature and a viscosity of the paint or glue material.

60. The process in accordance with claim 35, further comprising analyzing sound values obtained through the sound measuring with a frequency analysis.

61. The process in accordance with claim 60, wherein an entire spectrum of the measured sound is analyzed.

62. The process in accordance with claim 60, wherein at least one preset frequency band of the measured sound is analyzed.

63. The process in accordance with claim 62, wherein only one preset frequency band of the measured sound is analyzed.

64. The process in accordance with claim 35, wherein the sound measuring is performed for at least one preset frequency, and at least one sound value obtained through the sound measuring for a preset frequency is compared with a preset upper limit value.

65. The process in accordance with claim 35, wherein the machine comprises a paper machine.

66. The process in accordance with claim 35, wherein the machine comprises a stand alone calender.

67. The process in accordance with claim 35, wherein the machine comprises a speed sizer.

68. The process in accordance with claim 35, wherein the machine comprises a size press.

* * * * *